United States Patent [19]

Fay

[11] Patent Number: 4,649,606

[45] Date of Patent: Mar. 17, 1987

[54] METHOD AND APPARATUS TO SHEAR THE SURFACE OF A PILE FABRIC

[75] Inventor: Robert C. Fay, Spartanburg, S.C.

[73] Assignee: Milliken Research Corporation, Spartanburg, S.C.

[21] Appl. No.: 830,832

[22] Filed: Feb. 19, 1986

[51] Int. Cl.[4] ..... D06C 13/00

[52] U.S. Cl. ..... 26/15 R

[58] Field of Search ..... 26/15 R, 15 L, 15 FB, 26/2 R; 28/173

[56] References Cited

U.S. PATENT DOCUMENTS 2,695,438 11/1954 Bejeuhr ..... 26/15 R 4,103,390 8/1978 Tucker ..... 28/173

FOREIGN PATENT DOCUMENTS 53758 11/1911 Switzerland ..... 26/15 R

*Primary Examiner*—Robert R. Mackey

*Attorney, Agent, or Firm*—Earle R. Marden; H. William Petry

[57] ABSTRACT

Apparatus and method to raise the edge fibers of a cut pile carpet tile to ensure that they are cut by the rotating shear which is cutting the rest of the fibers in the tile. The tiles are overfed into the shear so that they abut one another causing the edge fiber, on the edge transverse to the direction of travel of the tiles, to be pushed upwardly. At a position adjacent the shearing member air under pressure is supplied against the traveling edge of the carpet tile to project the edge fibers into the upstanding position.

17 Claims, 6 Drawing Figures

METHOD AND APPARATUS TO SHEAR THE SURFACE OF A PILE FABRIC

This invention relates generally to an apparatus and method to efficiently shear the upstanding fibers of a pile fabric and in particular to an apparatus and method to shear the upstanding fibers of a cut pile carpet tile.

When shearing cut pile fabrics, such as cut pile carpet tiles, the fibers around the edges of the fabric tend to project outwardly in the plane of the fabric rather than upwardly. Consequently, when the tile is run under a rotating shear, the outwardly projecting fibers do not get trimmed. Then, when the tile is brushed or vacuumed, a ragged appearance is presented due to the edge fibers projecting upwardly beyond the surface of the carpet tile.

Therefore, it is an object of the invention to provide a method and apparatus to cut all of the fibers in the surface of pile fabric to provide an even surface appearance.

Other objects and advantages of the invention will become readily apparent as the specification proceeds to describe the invention with reference to the accompanying drawings, in which.

Figure 1:
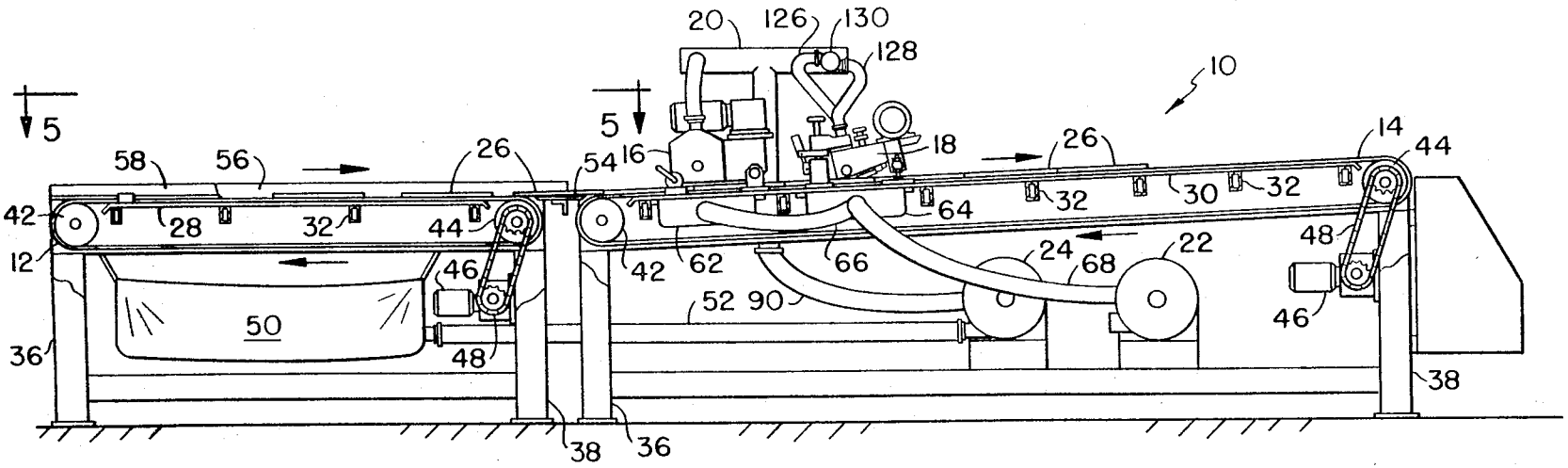
FIG. 1 is a schematic elevation view of the new and novel fabric shearing machine.

Looking now to FIG. 1, the basic shearing machine 10 is shown schematically. The machine basically consists of a pair of endless conveyors 12 and 14, a brushing station 16, a shearing station 18, a suction manifold 20 and a pair of vacuum pumps or fans 22 and 24.

As discussed briefly, the invention is directed to the shearing of any fabric with upwardly projecting fibers but in particular to the shearing of the surface fibers of a cut pile carpet tile 26. The carpet tiles 26 are loaded on the conveyer 12 running at a speed of approximately 19 ft./minute which conveys them to the conveyor 14 running at the speed of 18 ft./minute. Due to the approximate 5% difference in speed, the tiles will abut one another on the conveyor belt 14 forcing the fibers at the edges of the tile at the abutting point to be pushed to the upstanding position prior to entering the brushing section 16.

The endless conveyors 12 and 14 are of an open construction, such as an open weave fabric, and are supported by plates 28 and 30, respectively, on beams 32 extending transverse to the path of travel of the belts. As far as the invention is concerned, it is only necessary that the belt 14 be porous but as a practical matter, the belts 12 and 14 are of the same construction. The plate 28 is preferably imperforate while the plate 30 has perforations 34 therein for reasons hereinafter explained.

Each of the conveyors 12 and 14 are supported on a pair of front support beams 36 and a pair of rear support beams 38 with a longitudinal beam 40 extending on both sides of each conveyor between the front and rear support beams. The plate support beams 32 extend between and are welded or otherwise secured to the inside of the longitudinal beams 40. Mounted between each pair of front support beams 36 in suitable bearings is an idler roll 42 for each of the conveyors 12 and 14. Mounted between each pair of rear support beams 38 is a conveyor roll 44 driven by a motor 46 through a sprocket chain 48. Mounted below the conveyor 12 is a lint collection bag 50 which is supplied lint via conduit 52 connected to the output sides of air pump 24. Mounted between the conveyors 12 and 14 is a plate 54 to provide a smooth transition for the carpet tiles as they travel from the conveyor 12 onto the conveyor 14.

As mentioned before, the conveyor 12 is the inlet conveyor for the carpet tiles 26. To properly supply the carpet tiles 26 into the desired position in the conveyor 14, a pair of converging guide plates 56 and 58 are secured at the sides of the conveyor belt 12 to cam the tiles into alignment. The plates 56 and 58 are held in position by a plurality of brackets 60 welded or otherwise secured to the outside of the plates 56 and 58 at one end and secured by screws (not shown) at the other end to the plate 28.

Once the tiles 26 are aligned on the conveyor 12, they are conveyed onto the conveyor 14 for brushing and shearing. As mentioned before, the plate 30 has perforations 34 therein which communicate with the suction side of the air pump or fan 22 through the suction manifolds 62 and 64 and the suction conduits 66 and 68. The suction pressure exerted through the perforations 34 holds the carpet tiles 26 in desired flat condition and position on the porous conveyor belt 14. As shown in detail in FIG. 2, the tiles pass first into the brushing station 16 and then to the shearing station 18.

The brushing station basically consists of a rotatably mounted brush 70 driven at a speed of approximately 87½ rpm by the motor 72 through the drive belt 74. The brush 70 is contained within a housing 76 connected to the housing 78 on top of which is mounted the brush motor 72. The housing 78 and the elements connected thereto is pivotally mounted to the plate 30 by brackets 79, mounted on both sides of the conveyor 14, which have stub shafts 80 rotatably mounted therein and connected to the sides of housing 78. The pivotal movement of the brush 70 can be adjusted by rotation of the flat sided eccentric 82 by the movement of the handle 84. Connected to the top of housing 76 is a suction conduit 86 which communicates with the suction manifold 20 in communication with the suction side of the air pump or fan 24 via suction conduit 90.

The shearing station 18 basically consists of a rotary mounted reel type cutter mechanism 92 and cooperating blade 94, a housing 96 and a motor 98 thereon driving the cutter mechanism 92 at a speed of approximately 1750 r.p.m. through the belt 100. The housing 96 is pivotally mounted by a rod 102 which projects through the brackets 104 on both sides of the housing 96. The outer ends of the rod 102 are flattened and secured between nuts 106 threaded to bolts 108 connected to the plate 30. To position the housing 96, a stop block 109 is mounted on the plate 30 to engage the screw 110, screwed through the bracket 112 mounted on top of the housing 96. To provide automatic pivoting of the cutter into and out of operating position with respect to the tiles 26, a solenoid actuated piston 114 is pivotally connected at 116 to the member 118 connected to the bracket 112 and has its piston rod 120 pivotally connected at 122 to the stop block 109. The piston, upon activation and deactivation of the solenoid, will raise and lower the housing 96 and consequently the cutter mechanism 92 and blade 94. A thumb screw arrangement 124 is suitably connected to the blade 94 to manually position same where desired.

To collect the lint and fly generated by the cutter mechanism 92, suction conduits 126 and 128 are connected to the top of the housing 96 and deliver lint and fly tangentially into the conduit 130 which is connected to the suction manifold 20. A clear portion 132 of glass or plexiglass is provided in the conduit 130 so that the machine operator can observe the amount of lint being delivered from the housing 96 to the manifold 20.

Figure 2:
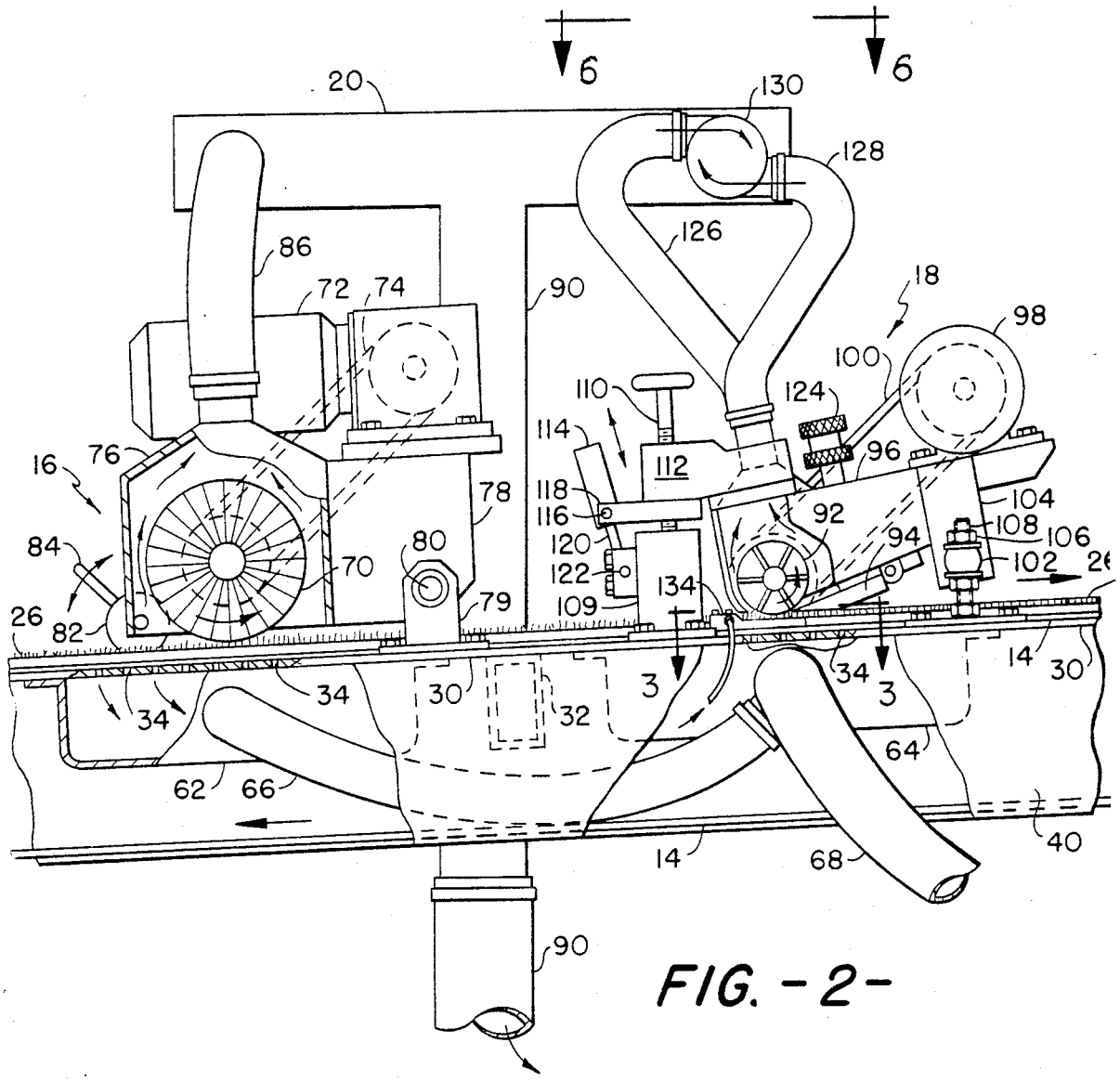
FIG. 2 is a partial section view of the brushing and shearing section of the machine shown in FIG. 1.
Figure 3:
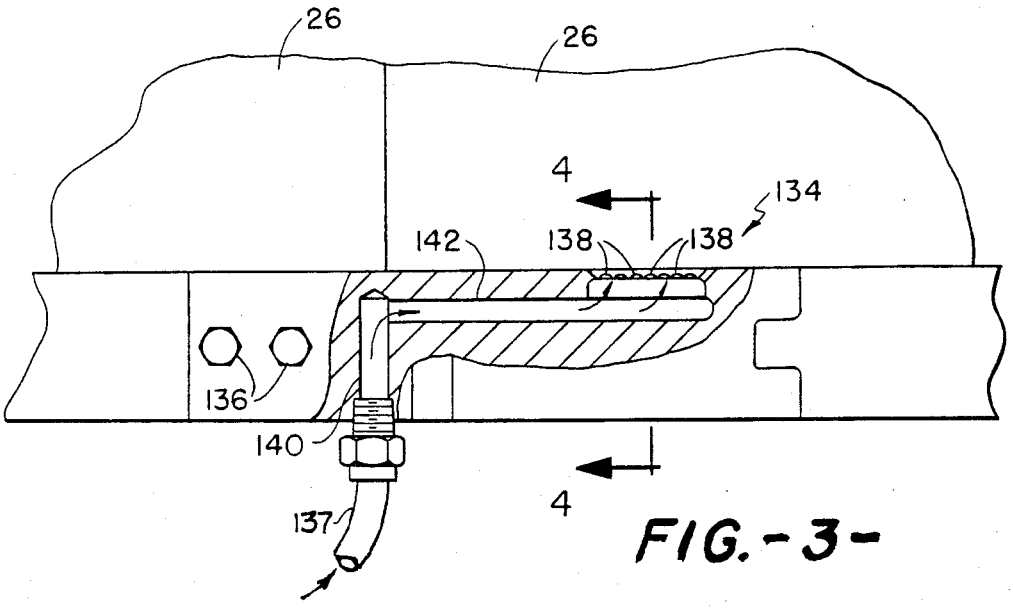
FIG. 3 is a blown-up partially cross-sectional top view of the air assist edge fiber straightener shown in the direction indicated by line 3—3 in FIG. 2.
Figure 4:
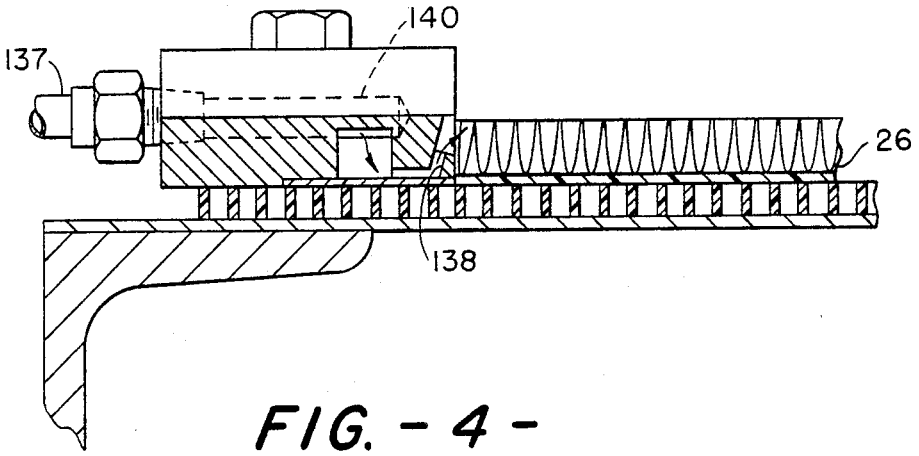
FIG. 4 is a cross-section view taken on line 4—4 of FIG. 3.
Figure 5:
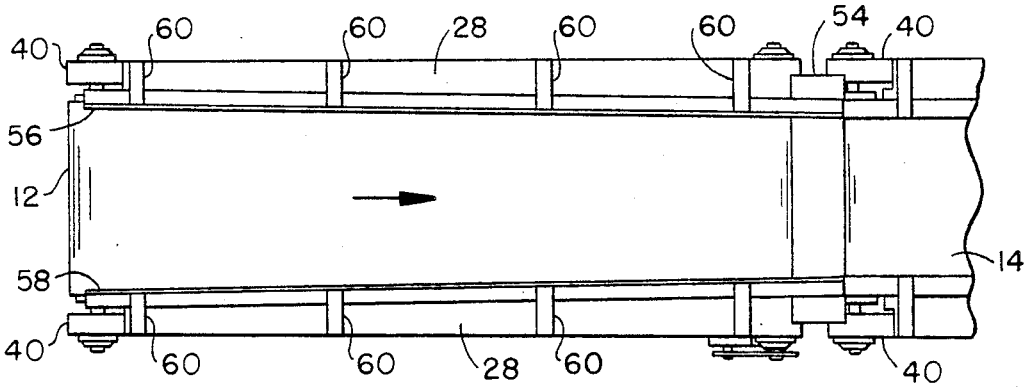
FIG. 5 is a top view taken on line 5—5 of FIG. 1 showing the inlet end of the fabric shearing machine.
Figure 6:
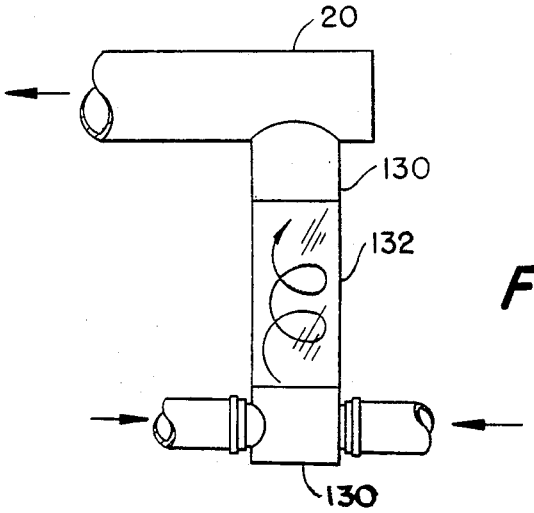
FIG. 6 is a top view taken on line 6—6 of FIG. 2 showing a portion of the lint collection manifold.

Looking now to FIGS. 2–4 and in particular to FIGS. 3 and 4, there is shown an apparatus 134 to raise and straighten the edge fibers of each carpet tile 26 prior to exposure to the cutting mechanism 92. The apparatus 134 is an air nozzle device mounted on both sides of the conveyor belt 14 by suitable means such as bolts 136 and having a plurality of nozzles 138 formed therein blowing air under pressure at an angle to the fibers in the carpet tile 26 to maintain the edge fibers in an upright position. The air under pressure to each apparatus 134 is supplied by conduit 140 connected to a source of high pressure air and passes from the conduit 137 through conduits 140 and 142 to the nozzles 138.

OPERATION

The carpet tiles to be sheared are placed on the conveyor belt 12 and as they travel down to the slower moving belt 14, are aligned by the guides 56 and 58 and abut one another in the direction of travel of the belts 12 and 14 due to the difference in speed. As the tiles 26 abut one another, the pile fibers on the transverse edges of the abutting tiles are forced to an upward position. The tiles 26 then pass over the plate 54 onto the conveyor belt 14 and are conveyed under the rotating brush 70 to brush the lint and debris from the surface thereof and to raise the tops of the fibers for shearing. The tiles 26 then pass the air nozzles 138 whereat the fibers on the longitudinal edges of the tile are blown to an upstanding position. Then, the tiles 26 pass under the cooperating cutter mechanism 92 and blade 94 where the surface fibers of the carpet tile 26 are sheared to provide an even, smooth tile surface. The tiles 26 are then conveyed downstream of the shearing station and collected in any suitable manner.

As described hereinbefore, the air pump or fan 22 provides suction pressure through the apertures 34 in the plate 30 under the belt 14 to hold the tiles in position while being brushed and sheared. The air pump or fan 24 provides the removal of lint and debris from the surface of the carpet tiles at the brushing and cutting station and delivers same to the collection bag 50 via conduit 52. The sight glass 132 in the conduit 130 provides the operator an inspection point to visually determine the amount of fibers being sheared from the surface of the carpet tiles to allow the necessary adjustments to the position of the cutter mechanism 92 and the blade 94.

It can be seen that an apparatus and method has been described which will shear all of the fibers on a pile fabric such as a carpet tile and ensure that the fabric is properly aligned with the edge fibers in correct position for shearing. Furthermore, the apparatus provides for ready removal of lint from the operation while providing visual detection of the amount of fibers being sheared.

Although the preferred embodiment of the invention has been described, it is contemplated that changes may be made without departing from the scope or spirit of the invention and it is desired that the invention only be limited by the claims.

I claim:

1. An apparatus to shear the fibers on the surface of a pile fabric comprising: a first endless conveyor, guide means on the sides of said first endless conveyor to align a plurality of pile fabrics on said conveyor, a second endless conveyor closely adjacent and in alignment with said first endless conveyor, means driving said first endless conveyor at a pre-determined speed, means driving said second endless conveyor at a speed less than the speed of said first endless conveyor whereby a pile fabric from said first conveyor abuts a pile fabric on said second endless conveyor to cause the pile fibers on the abutting fabric edges to be pushed upwardly and a cutter mechanism operably associated and located above said second endless conveyor to shear the surface of a pile fabric on said second endless conveyor.

2. The apparatus of claim 1 wherein a means is located on both sides of said second endless conveyor to raise the pile fibers on the edges of a pile fabric prior to passage of the pile fabric under the cutter mechanism.

3. The apparatus of claim 2 wherein said means to raise the pile fibers includes an air jet supplied with air under pressure.

4. The apparatus of claim 3 wherein a brushing mechanism is located over said second endless conveyor upstream of said cutter mechanism to brush pile fabric on said second endless conveyor prior to passage under the cutter mechanism.

5. The apparatus of claim 4 wherein said air jet is located between said brushing mechanism and said cutter mechanism.

6. The apparatus of claim 5 wherein said brushing mechanism and said cutter mechanism are each located in a housing which is in communication with a suction source to clean lint off of the pile fabric on said second endless conveyor.

7. The apparatus of claim 6 wherein said second endless conveyor is porous and a suction source is mounted under the upper reach of said second endless conveyor to suck the pile fabric onto the conveyor.

8. Apparatus to shear the fibers on the surface of a plurality of pile fabrics each having transverse edges and longitudinal edges comprising a first endless conveyor, a second endless conveyor, means operably associated with and driving said endless conveyor, a cutter mechanism located above and in operative relationship to said second endless conveyor and an air jet located on both sides of said second endless conveyor downstream of said cutter mechanism, said air jets being directed angularly upward to direct a stream of air against the fibers on the longitudinal edges of a pile fabric on said second endless conveyor to raise the fibers thereon prior to contacting said cutter mechanism when air under pressure is supplied to said air jet means, said air jets being solely directed against the edge fibers of a pile fabric on said second endless conveyor so as to not disturb the fibers on the pile fabric surface inward from the longitudinal edges thereof.

9. The apparatus of claim 8 wherein a brushing mechanism is located over said second endless conveyor upstream of said cutter mechanism to brush pile fabric on said second endless conveyor prior to passage under the cutter mechanism.

10. The apparatus of claim 9 wherein said air jet is located between said brushing mechanism and said cutter mechanism.

11. The apparatus of claim 10 wherein said brushing mechanism and said cutter mechanism are each located in a housing which is in communication with a suction source to clean lint off of the pile fabric on said second endless conveyor.

12. The apparatus of claim 11 wherein a suction conduit means provides communication with said housing and has a portion thereof transparent so that an operator can observe the amount of lint therein.

13. The apparatus of claim 12 wherein said second endless conveyor is porous and a suction source is mounted under the upper reach of said second endless conveyor to suck the fabric onto the second endless conveyor.

14. The method of shearing the pile surface of a pile carpet tile having predetermined dimensions comprising the steps of placing a plurality of carpet tiles on a first conveyor, aligning the carpet tiles on the first conveyor, supplying the carpet tiles from the first conveyor onto a second conveyor, driving the second conveyor at a speed slower than the first conveyor so that the carpet tiles abut one another on the second conveyor and push the fibers on the transverse edges of the abutting carpet tiles in an upward direction, forcing the fibers on the longitudinal edges of the abutting tiles in an upward direction and shearing the surface of the carpet tiles on the second conveyor after the fibers on the transverse and longitudinal edges have been forced in an upward direction.

15. The method of claim 14 wherein the fibers on the longitudinal edges of the carpet tiles are blown in the upward direction.

16. The method of claim 15 wherein the carpet tiles on the second conveyor are held in position by suction pressure.

17. The method of claim 16 wherein the carpet tiles are brushed prior to shearing of the surface thereof.

* * * * *